United States Patent [19]

Lautensleger et al.

[11] Patent Number: 4,993,095

[45] Date of Patent: Feb. 19, 1991

[54] SPLICE FOR A STRUCTURAL MEMBER

[75] Inventors: Richard W. Lautensleger; John N. Macadam, both of Middletown; Daniel F. Senf, West Chester; David C. Trimmer, Cincinnati, all of Ohio

[73] Assignee: Armco Inc., Middletown, Ohio

[21] Appl. No.: 434,948

[22] Filed: Nov. 9, 1989

[51] Int. Cl.[5] ..... E04C 3/02

[52] U.S. Cl. ..... 14/17; 14/13; 52/726

[58] Field of Search ..... 14/13, 14, 17, 73, 6, 14/4, 3; 52/726, 731

[56] References Cited

U.S. PATENT DOCUMENTS

| | | | |
|---|---|---|---|
| 141,293 | 7/1873 | Schwatka | 14/13 |
| 424,427 | 3/1890 | Mertens | 14/14 |
| 444,579 | 1/1891 | Jackson | 52/726 |
| 757,804 | 4/1904 | Dildine | 14/14 |
| 2,125,692 | 8/1938 | Ragsdale et al. | 189/37 |
| 3,284,977 | 11/1966 | Lickliter et al. | 52/726 |
| 3,420,032 | 1/1969 | Felt | 52/731 |
| 3,606,418 | 9/1971 | Buker et al. | 52/726 |
| 4,081,941 | 4/1978 | Van Ausdall | 52/726 |
| 4,550,539 | 11/1985 | Foster | 52/731 |
| 4,649,683 | 3/1987 | Dolata | 52/726 |
| 4,733,986 | 3/1988 | Kenning et al. | 52/726 |
| 4,738,071 | 4/1988 | Ezard | 52/726 |

FOREIGN PATENT DOCUMENTS

| | | | |
|---|---|---|---|
| 54583 | 5/1950 | France | 52/726 |

OTHER PUBLICATIONS

The Lincoln Electric Co Arc Welding ©1945.

*Primary Examiner*—Ramon S. Britts
*Assistant Examiner*—Gay Ann Spahn
*Attorney, Agent, or Firm*—R. J. Bunyard; L. A. Fillnow; R. H. Johnson

[57] ABSTRACT

Spliced structural members for supporting a traffic deck on a short span bridge. A spliced structural member includes a plurality of metal box-shaped girder segments placed end to end and splice channels nested around the adjacent ends of the girder segments. A spliced joint is formed by connecting the splice channels to the adjacent ends of the girder segments. The spliced joint has at least 75% of the flexural and shear strength of the girder segments and provides continuity for structural strength and rigidity for the spliced structural member.

17 Claims, 4 Drawing Sheets

SPLICE FOR A STRUCTURAL MEMBER

BACKGROUND OF THE INVENTION

This invention relates to a spliced structural member. More particularly, a plurality of girder segments are placed end to end and splice channels are nested around and connected to the adjacent ends of the girder segments to form a spliced joint in the structural member. The spliced joint has at least 75% of the flexural and shear strength of any one of the girder segments and provides continuity for structural strength and rigidity for the spliced structural member.

It is known that structural members such as beams, girders, columns and the like can be fabricated in various shapes from light weight, structural materials. Box-shaped girder segments are normally manufactured by press brake-forming metal sheet or by cold rolling metal strip into a C-shape configuration and arc or resistance welding a pair of the C-shape members into a box configuration. The length of a span such as in a bridge or a building for which structural members provide load support often exceeds the nominal length of such conventionally produced girder segments. Manufacturing and transportation limitations also restrict the length availability of girder segments.

It is known that girder segments can be structurally joined end to end using splice plates or by welding. Splice plates are bulky, clutter the top surface, time consuming to connect, and impractical to use inside of box-shaped girder segments. All these problems can be overcome when welding capability is available at the job site to splice the girder segments into the required length by butt welding the girder segments end to end. However, field welding conditions are usually poor because welding equipment and qualified welding personnel frequently are unavailable in many remote areas, especially in third world countries.

Accordingly, there remains a long felt need for an improved mechanical splice that is shop fabricated to minimize the time, equipment and skill necessary to assemble a spliced structural member at the jobsite. Furthermore, the spliced structural member must develop high strength and be able to transfer structural strength and rigidity through the spliced joint connecting girder segments. The splice also must be readily transportable and the upper surface of the splice be free of bolts to prevent interference with placement of a bridge deck when the structural member is used as a bridge girder or with placement of a floor, wall or roof deck when the structural member is used as a building frame component.

BRIEF SUMMARY OF THE INVENTION

The invention relates to a spliced structural member including a plurality of girder segments placed end to end with a splice channel nested around and connected to each of the adjacent ends of the girder segments for forming a spliced joint. The spliced joint provides continuity for structural strength and rigidity for the spliced structural member.

It is a principal objective of the invention to provide a spliced structural member having at least 75% of the flexural and shear strength of a girder segment. Another objective of the invention is to provide a spliced joint that provides continuity for torsional rigidity for a spliced structural member. Additional objectives include a spliced structural member whose components can be easily transported and a spliced joint that does not interfere with placement of a bridge deck when the structural member is used as a bridge girder, or with placement of a floor, wall or roof deck when the structural member is used as a building frame component.

A feature of the invention is to provide a spliced structural member including a plurality of girder segments placed end to end with a splice channel nested around and connected to each of the adjacent ends of the girder segments for forming a spliced joint.

Another feature of the invention includes providing a spliced structural member including a plurality of metal box-shaped girder segments placed end to end with a splice channel nested around and connected to each of the adjacent ends of the girder segments for forming a spliced joint.

Another feature of the invention includes providing a spliced structural member including a plurality of metal box-shaped girder segments placed end to end with a pair of splice channels nested around and connected to each of the adjacent ends of the girder segments for forming a spliced joint wherein each of the girder segments is formed from a pair of juxtaposed C-shaped members.

Another feature of the invention includes connecting a splice channel to box-shaped girder segments by threading bolts through a web of the splice channel into predrilled and tapped bars welded to the inside box corners of each of the box-shaped girder segments.

Another feature of the invention includes providing opposing ends of a pair of juxtaposed C-shaped members with an extension to form a staggered joint when the girder segments are placed end to end.

Another feature of the invention includes connecting a plate to an outer surface of the girder segments.

Advantages of the invention include a spliced structural member having convenient shipping lengths, an upper surface free of exposed bolts, reduced installation costs and rapid field assembly.

The above and other objectives, features and advantages of the invention will become apparent upon consideration of the detailed description and appended drawings.

DETAILED DESCRIPTION OF THE PREFERRED EMBODIMENT

Figure 1:
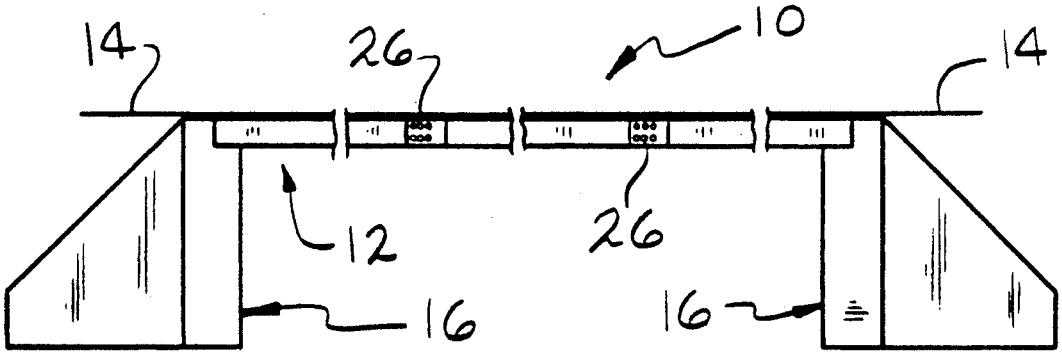
FIG. 1 is an elevational view illustrating a short span bridge incorporating the invention.
Figure 2:
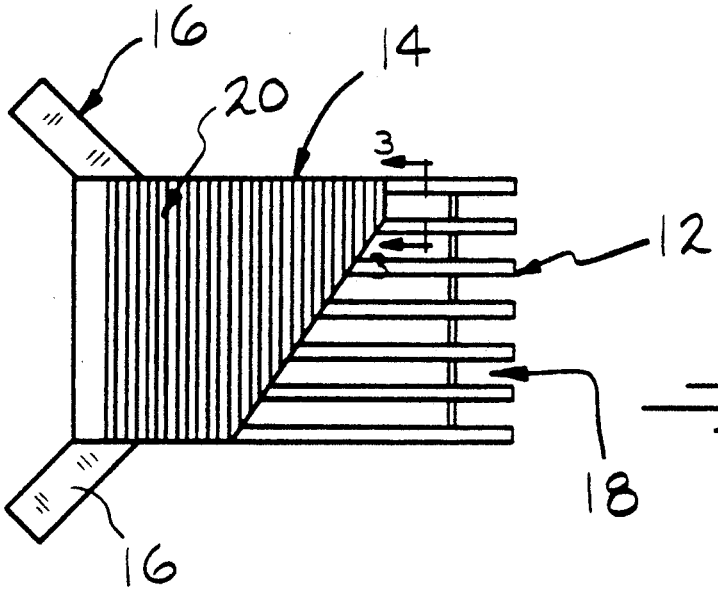
FIG. 2 is a plan view, partially in section, illustrating a portion of the bridge of FIG. 1.
Figure 3:
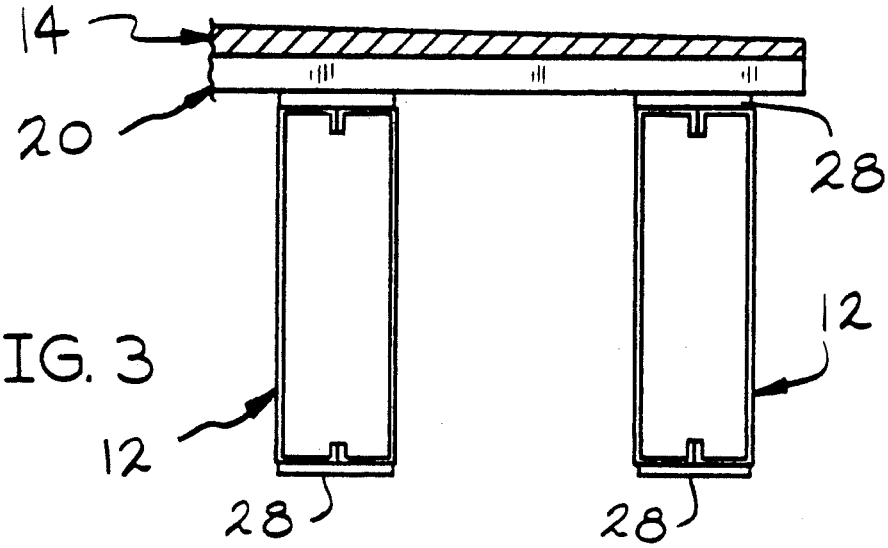
FIG. 3 is an enlarged elevational section view along the line 3—3 in FIG. 2.

Reference numeral 10 in FIG. 1 generally refers to a short span bridge, i.e., 5–25 meters, for which a spliced structural member of the invention can be used. It will be understood the spliced structural member of the invention could be used as a load supporting member in other structures such as buildings. Bridge 10 includes a plurality of spliced structural members 12 for supporting a road surface 14, and opposing abutments 16 for supporting spliced structural members 12. Spliced structural members 12 may be braced by a transverse brace 18 as illustrated in FIG. 2. It is well known and illustrated in FIGS. 2 and 3 that road surface 14 on bridge 10 may include a decking material such as steel planking 20.

Figure 4A:
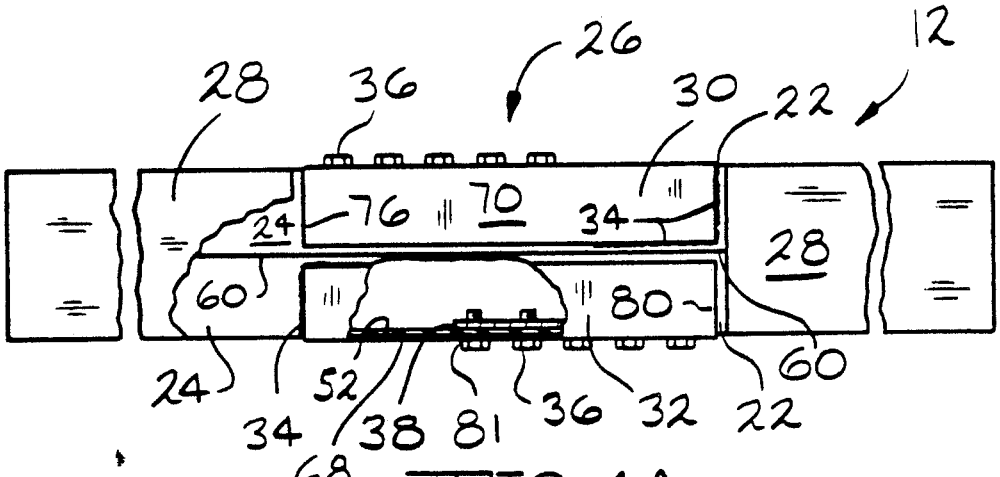
FIG. 4A is a plan view, partially in section, of a spliced joint of the invention.
Figure 4B:
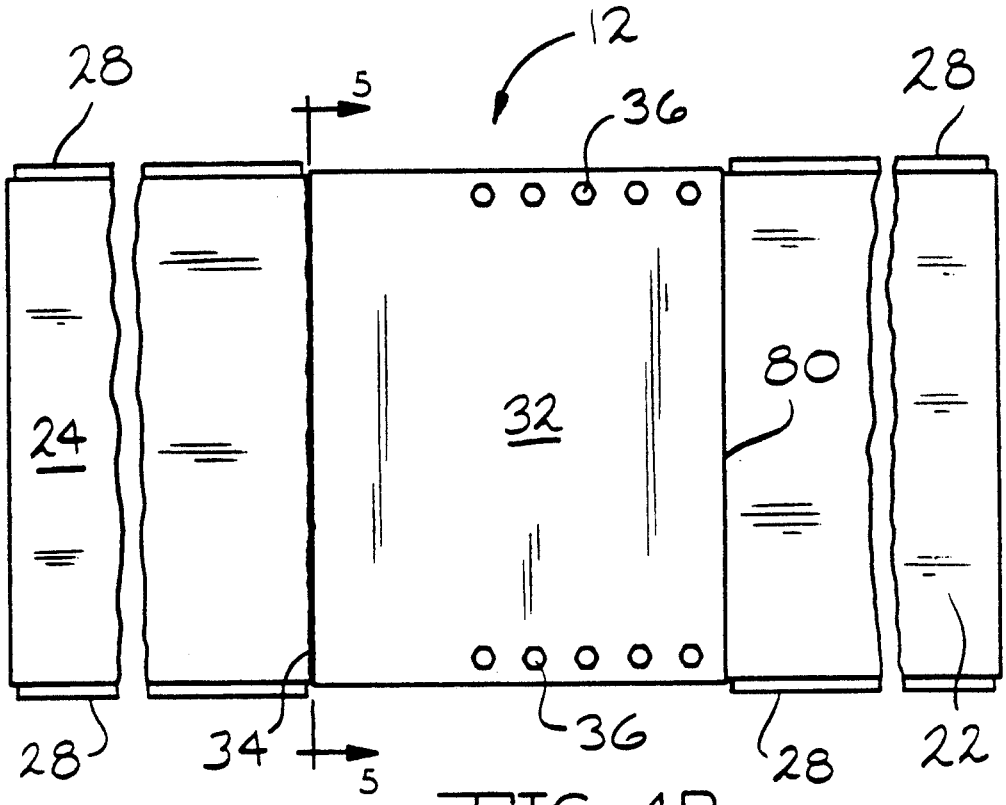
FIG. 4B is an elevational view of the spliced joint shown in FIG. 4A.

As illustrated in FIGS. 4A and 4B, spliced structural member 12 includes a plurality of girder segments placed end to end such as steel rectangular box-shaped girder segments 22 and 24. It will be understood the girder segments could be any convenient hollow configuration also including shapes such as a square box-shape, a trapezoid, and the like, and generally manufactured in lengths of about 2–5 meters. In some situations, it may be desirable that girder segment 22 be made from steel having a different thickness than the steel for forming girder segment 24. Those girder segments in a structural member toward the abutments in a bridge require less bending strength than those girder segments in the central portion of the bridge span. Accordingly, girder segments adjacent to or near the abutments may be made from thinner metal than those girder segments positioned in the central portion of the structural member. A spliced joint 26 is formed by nesting or overlapping a splice channel around the adjacent ends of girder segments 22 and 24. Although only a single closed splice channel need be used and nested over the girder segment adjacent ends, it is preferred to use a pair of splice channels 30 and 32. As in the case with girder segments 22 and 24, various hollow configurations corresponding to the configuration of the girder segments can be used with a rectangular box-shape being preferred. One end of each of channel 30 and 32 may be shop welded to girder segments 22 and 24 such as by a weld 34. Final assembly of splice joint 26 is completed at the jobsite by connecting the opposite ends (unwelded) of channels 30 and 32 with threaded fasteners 36 to bars 38. The webs of girder segments 22 and 24 and bars 36 are preferably drilled with holes with the holes in the bars also tapped with threads. Bars 38 are positioned on the upper and lower inside surfaces of the webs (box corners) of girder segments 22 and 24 so that the holes in each bar are aligned with holes in the girder segments with the bars being shop welded to the girder segments. By using threaded bars 38 for anchoring fasteners 36, the box corners of girder segments 22 and 24 are reinforced. Structural members 12 preferably include a plate 28 fastened to the upper and lower surfaces and positioned intermediate to spliced joints 26. As illustrated in FIG. 4B, structural member 12 includes plates 28 welded to the upper and lower surfaces of girder segments 22 and 24. Plates 28 are positioned closely to but without overlapping splice channels 30 and 32. Plate 28 is a reinforcing component acting as a flange stiffener providing additional bending strength and a higher moment of inertia for structural member 12.

Figure 5:
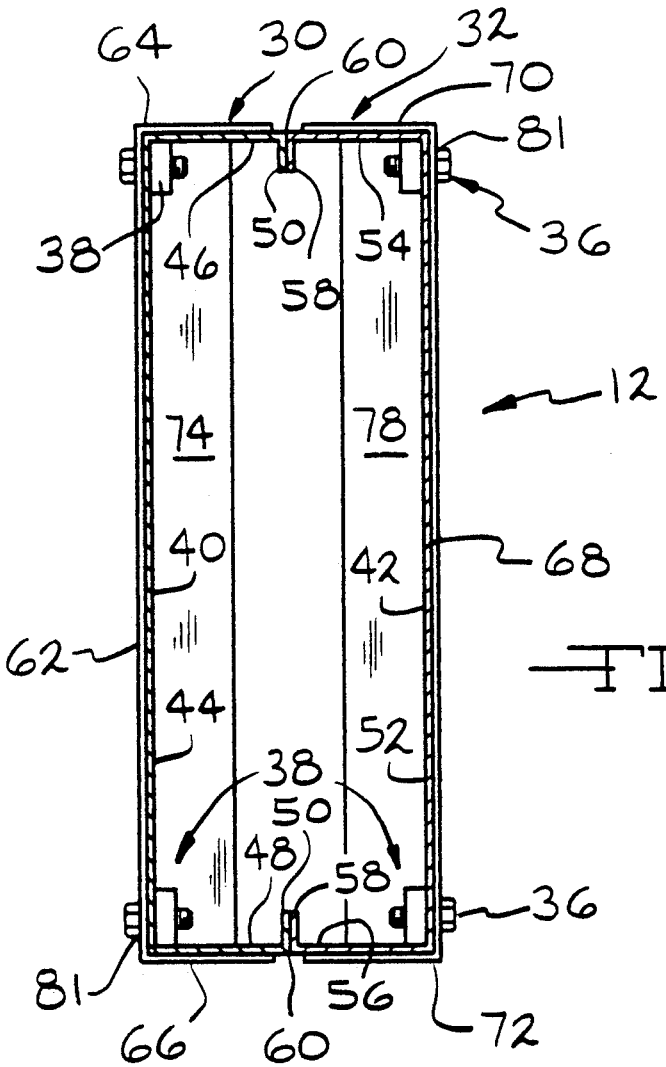
FIG. 5 is a section view along the line 5—5 in FIG. 4B.

As illustrated in FIG. 5, each box-shaped girder segment includes a pair of juxtaposed C-shaped members 40 and 42. C-shaped member 40 includes a web 44, an upper flange 46, a lower flange 48 and a pair of flange stiffeners 50 perpendicular to flanges 46, 48 and extending along the longitudinal axis of structural member 12 substantially parallel to web 44. C-shaped member 42 includes a web 52, an upper flange 54, a lower flange 56 and a pair of flange stiffeners 58 perpendicular to flanges 54, 56 and extending along the longitudinal axis of structural member 12 substantially parallel to web 52. Flange stiffeners 50 and 58 of C-shaped members 40 and 42 are abutted and structurally connected into a longitudinally extending seam 60 (see FIGS. 4A and 6) such as by shop welding to form girder segments 22 and 24. Spliced joint 26 is formed by nesting channels 30 and 32 around corresponding C-shaped members 40 and 42 of the adjacent ends of girder segments 22 and 24. Channel 30 includes a web 62, an upper flange 64, and a lower flange 66 for nesting with corresponding members 44, 46 and 48 respectively of C-shaped member 40. Similarly, channel 32 includes a web 68, an upper flange 70, and a lower flange 72 for nesting with corresponding members 52, 54 and 56 respectively of C-shaped member 42. Bar 38 is placed at the inside top and bottom positions of the web at each of the box corners of the extended end of each girder segment. As clearly illustrated in FIGS. 4A, 4B and 5, the top and bottom of spliced structural member 12 is clean and free of any protruding fasteners permitting either the top or bottom surfaces of spliced structural member 12 to be conveniently used to support a road surface over a bridge. Furthermore, by threading fasteners 36 directly into prethreaded bars 38 rather than using nuts, easy assembly of the spliced joint at the jobsite is accomplished.

Figure 6:
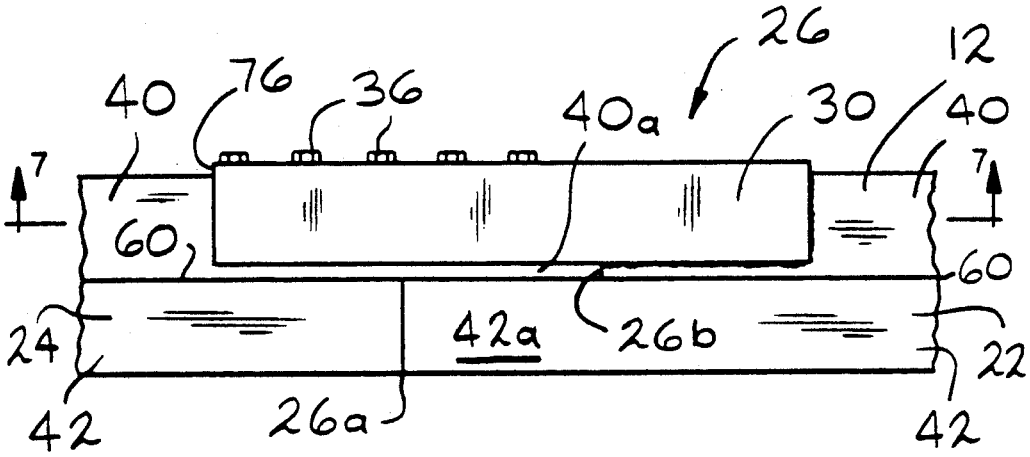
FIG. 6 is a plan view of another embodiment of a splice joint of the invention.

FIG. 6 illustrates a preferred embodiment, with channel 32 and plates 28 removed for clarity, of forming a off-set or staggered spliced joint with opposing ends of the juxtaposed members having extensions. C-shaped member 40 of girder segment 24 includes an extension **40*a* and C-shaped member 42 of girder segment 22 includes an opposing extension 42*a*. When girder segments 22 and 24 are placed end to end, off-set or staggered joints 26*a* and 26*b* are formed. Splice joint 26 with staggered portions 26*a* and 26*b* is stronger than it would be have been if portions 26*a* and 26*b* were opposite to each other. The bolted or free edges of C-shaped members 40 and 42 are the most heavily loaded points in spliced joint 26. Accordingly, splice joint 26 can be further strengthened by welding a reinforcing element 74 (see FIGS. 5 and 7) to web 44 and flanges 46 and 48 of C-shaped member 40 at a position substantially parallel and near to free edge 76 of channel 30. A reinforcing element 78 (see FIG. 5) is also welded to web 52 and flanges 54 and 56 of C-shaped member 42 at a position substantially parallel and near to free edge 80 of channel 32. Reinforcing elements positioned vertically along the webs of structural members 12** in the vicinity of the free edge of a splice channel strengthen the spliced joints by increasing buckling resistance. Use of a staggered joint and reinforcing elements strengthens a spliced structural member to have at least 75% of the flexual and shear strength of the girder segments.

Figure 7:
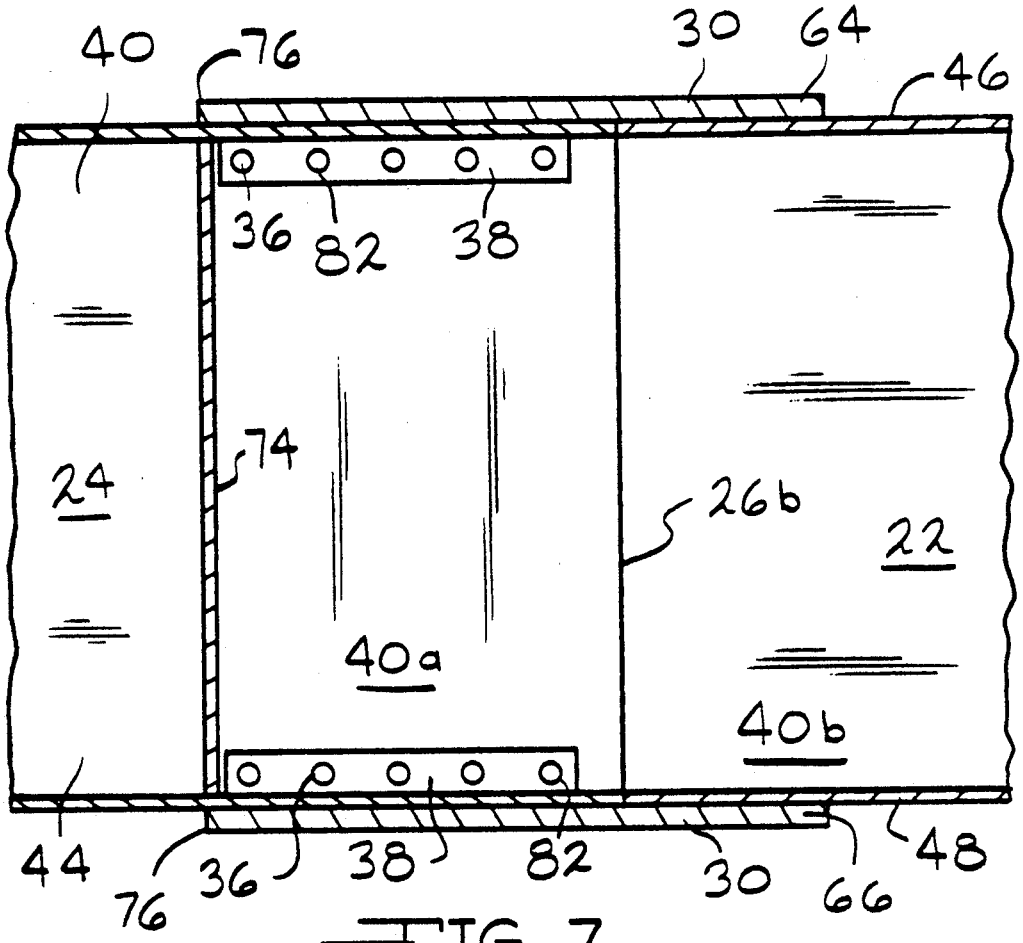
FIG. 7 is an elevation view along line 7—7 of FIG. 6.

FIG. 7 illustrates reinforcing element 74 extending from upper flange 46 to lower flange 48 vertically along web 44 of C-shaped member 40 (see also FIG. 5). The upper and lower portions of the webs of the C-shaped members of the girder segments and splice channels are drilled in the shop with spaced holes 81 (FIG. 5) for receiving bolts 36. Corresponding spaced threaded holes 82 also are drilled and tapped into bars 38. Holes 81 in the girder segment webs 44 and 52 and threaded holes 82 in bars 38 are aligned before bars 38 are welded to webs 44 and 52 of C-shaped members 40 and 42 respectively. Alternatively, the bar can be welded to the girder segment web with the web and bar drilled simutaneously. Since bolts 36 need only be threadably connected to bars 38, the holes in the webs need not be threaded.

Performing the maximum amount of fabrication possible in the shop minimizes the time, amount of heavy equipment and skilled labor required for assembly of the spliced structural members at the jobsite. In fact, the only operations required for assembly of the spliced joint at the jobsite include placing the girder segments end to end, aligning the holes in the splice channels with corresponding holes in the C-shaped members, and then threading bolts into the bars. One or both ends of each girder segment can be shop fabricated to include one end of a splice channel already welded thereto. Depending on the length of the girder segments and type of transportation equipment available to deliver girder segments to the jobsite, one or more of splice joints 26 of each structural member 12 may be completely assembled in the shop. Assembly at the jobsite merely requires a first girder segment having one end including a splice channel to be placed end to end with a second girder segment whose adjacent end also includes a splice channel, aligning the splice channel holes of both girder segments with corresponding web holes, and threadably connecting the splice channels to the webs.

Figure 8:
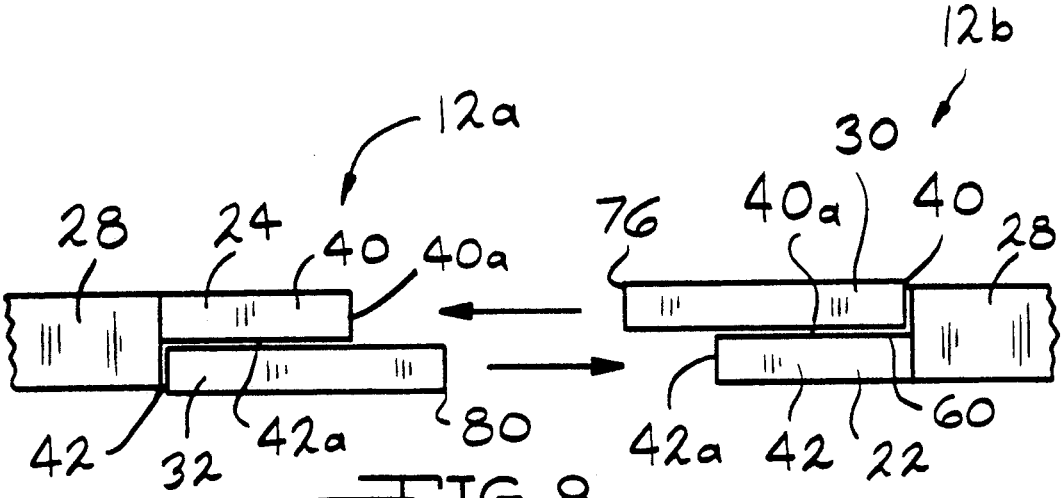
FIG. 8 is a plan view showing the field assembly of a splice joint for a pair of girder segments including the features of FIGS. 4A, 4B, 6 and 7.

Assembly of the preferred embodiment of the spliced structural member for a typical 12 meter span of a highway bridge will now be described with reference to FIG. 8. In the shop, a steel box-shaped girder segment having a thickness of about 0.42 cm and dimensions of about 25 cm by about 79 cm by about 300 cm in length was formed by positioning the open sides of identical C-shaped members 40 and 42 opposite one another in a jig so that the flange stiffener of the upper and lower flanges of each of the C-shaped members contact each other. Reinforcing elements 74 and 78 were previously welded to the inside web surface of each C-shape member extending from the upper flange to the lower flange. The C-shaped members 40 and 42 were off-set slightly relative to one another by about 20 cm so that free edge 40*a* of C-shaped member 40 extends beyond free edge 42*a* of C-shaped member 42. Flange stiffeners 50 (FIG. 5) of member 40 may then be arc or resistance welded to flange stiffeners 58 of member 42 forming seam 60 extending the length of formed girder segment 24. Longitudinally extending spaced holes are drilled at each box corner near free edge 40*a* of C-shaped member 40 of girder segment 24 and at each box corner near free edge 42*a* at the opposite end of C-shaped member 42 of girder segment 22. The same number of holes of corresponding spacing are drilled and tapped into steel bars. A bar is positioned at each drilled box corner so that the holes in the bars are in alignment with corresponding holes in the girder segment. The bars are welded to the inside web surfaces of the girder segment. Girder segment 22 would be formed, provided with holes, and have the bars positioned and welded at its box corners in a similar manner as that described for girder segment 24. Splice channel 32, having a C-shape whose inside dimension is the same or slightly larger than the outside dimension of the girder segments, is nested over free edge 42*a* of girder segment 24 so that free edge 80 of splice channel 32 is off-set relative to free edge 40*a* of girder segment 24 a distance of about 20 cm. The end of splice channel 32 opposite free edge 80 is then welded to C-shape member 42. Splice channel 30 is structurally connected to C-shape member 40 of girder segment 22 in a similar manner. Steel plates 28 may be placed on the upper and lower surfaces of girder segments 22 ad 24 and positioned adjacent the welded ends of C-shape members 30 and 32. Plates 28 may be welded along the entire length of girder segments 22 and 24. The girder segments having partially assembled splice joints are now transported to the jobsite. At the jobsite, girder segments 22 and 24 are aligned in the manner illustrated in FIG. 8. Free edge 76 of splice channel 30 on girder segment 22 is telescoped over free edge 40*a* of girder segment 24 to a point at or near the edge of plate 28 so that the holes in the box corners of splice channel 30 near free edge 76 are aligned with the holes in the bars welded in the box corners of C-shape member 40 of girder segment 24. Simultaneously, free edge 80 of of splice channel 32 on girder segment 24 is telescoped over free edge 42*a* of girder segment 22 to a point at or near plate 28. Bolts are then passed through the holes in the splice channels and girder segment webs and threaded into the bars welded to the C-shape members to complete the structural splice joint.

It will be understood various modifications may be made to the invention without departing from the scope of it. For example, the girder segments and splice channels may include various materials, thicknesses, dimensions and shapes. Various connecting means, stiffeners and bracing may be used. Therefore, the limits of the invention should be determined from the appended claims.

We claim:

1. A spliced structural member, comprising:

a plurality of girder segments placed end to end, each of said girder segments including a pair of juxtaposed members, each of said juxtaposed members having substantially identical cross-section shape and including a web, an upper flange and a lower flange, said flanges substantially perpendicular to said web, each said flange including a free edge, each said free edge including a flange stiffener substantially parallel to said web, said flange stiffener of one of said juxtaposed members structurally connected to said flange stiffener of the other of said juxtaposed members, a splice channel nested around the adjacent ends of said girder segments, said splice channel structurally connected to said adjacent ends of said girder segments for forming a spliced joint, whereby said spliced joint provides continuity for structural strength and rigidity for the spliced structural member.

2. The spliced structural member of claim 1 wherein each said girder segment has a box-shaped cross-section.

3. The spliced structural member of claim 1 wherein the inside surface of said girder segments includes a reinforcing element.

4. The spliced structural member of claim 1 including a plurality of bars, said bars including a first plurality of threaded holes, said girder segments including webs, said web of one of an adjacent pair of said girder segments including a second plurality of holes, one end of said splice channel including a third plurality of holes, said bars welded to said girder segments so that said first holes are aligned with said second holes, said holes of said splice channel aligned with said first holes, said one end of said splice channel bolted to said bars, the other end of said splice channel welded to said adjacent end of the other of said pair of said girder segments.

5. The spliced structural member of claim 1 wherein said spliced joint has at least 75% of the flexural and shear strength of said girder segments.

6. The spliced structural member of claim 1 wherein said girder segments include a plate connected to an outer surface for providing additional bending strength and a higher moment of inertia for said structural member.

7. The spliced structural member of claim 1 wherein said spliced joint includes a pair of C-shaped splice channels.

8. A spliced structural member, comprising:

a plurality of girder segments placed end to end, each said girder segment including a pair of juxtaposed members, each said juxtaposed member including a free edge, said free edges of said juxtaposed members being staggered, a splice channel nested around the adjacent ends of said girder segments, said splice channels structurally connected to said adjacent ends of said girder segments for forming a staggered spliced joint, whereby said spliced joint provides continuity for structural strength and rigidity for the spliced structural member.

9. The spliced structural member of claim 8 including a juxtaposed pair of said splice channels.

10. A spliced structural member, comprising:

a plurality of metal box-shaped girder segments placed end to end, each said girder segment including a pair of juxtaposed members, each of said juxtaposed members including a web, an upper flange and a lower flange, said flanges substantially perpendicular to said web, the free edge of each said flange including a flange stiffener substantially parallel to said web, said flange stiffener of one of said juxtaposed members structurally connected to said flange stiffener of the other of said juxtaposed members, a splice channel nested around the adjacent ends of said girder segments, said splice channel structurally connected to said adjacent ends of said girder segments for forming a spliced joint, whereby said spliced joint has at least 75% of the flexural and shear strength of said girder segments.

11. The spliced structural member of claim 10 wherein the free edges of said adjacent ends of each said juxtaposed members of said girder segments are staggered.

12. The spliced structural member of claim 10 wherein the inside surfaces of said webs including a reinforcing element.

13. The spliced structural member of claim 10 including a plurality of bars, said bars including a first plurality of threaded holes, said web of one of an adjacent pair of said girder segments including a second plurality of holes, one end of said splice channel including a third plurality of holes, said bars welded to said girder segments so that said first holes are aligned with said second holes, said holes of said splice channel aligned with said first holes, said one end of said splice channel bolted to said bars, the other end of said splice channel welded to said adjacent end of the other of said pair of said girder segments.

14. The spliced structural member of claim 10 wherein said girder segments include a plate connected to an outer surface for providing additional bending strength and a higher moment of inertia for said structural member.

15. The spliced structural member of claim 10 wherein said spliced joint includes a pair of C-shaped splice channels.

16. A short span bridge, comprising:

opposing abutments for supporting a plurality of longitudinally extending spliced structural members, said structural members for supporting a traffic deck, each of said structural members including a plurality of steel box-shaped girder segments placed end to end, each said girder segment including a pair of juxtaposed members, each of said juxtaposed members having substantially identical cross-section shape and including a web, an upper flange and a lower flange, each said web including a reinforcing element, said flanges substantially perpendicular to said web, the free edges of said adjacent ends of said juxtaposed members being staggered, a pair of C-shaped splice channels nested around the adjacent ends of said girder segments, said webs of an adjacent pair of said girder segments including a first plurality of threaded holes, a plurality of bars including a second plurality of threaded holes, said bars welded to the inside surfaces of said webs and said flanges of said girder segments so that said first holes are aligned with said second holes, two opposing ends of said splice channels including a third plurality of holes, said holes of said splice channels aligned with said first holes, said two ends of said splice channels bolted to said bars and the other two ends of said splice channels welded to said adjacent ends of said pair of said girder segments for forming a spliced joint, each of said girder segments including a plate connected to an outer surface, whereby said spliced joint has at least 75% of the flexural and shear strength of said girder segments.

17. The bridge of claim 16 wherein the free edge of each of said flanges includes a flange stiffener substantially parallel to said web, said flange stiffener of one of said juxtaposed members structurally connected to said flange stiffener of the other of said juxtaposed members.

* * * * *